US010339849B2

(12) United States Patent
Jin

(10) Patent No.: US 10,339,849 B2
(45) Date of Patent: Jul. 2, 2019

(54) METHOD AND SYSTEM FOR REGULATING BRIGHTNESS AND CHROMATICITY OF DISPLAY PANEL

(71) Applicant: Wuhan China Star Optoelectronics Technology Co., Ltd., Wuhan, Hubei (CN)

(72) Inventor: Yufeng Jin, Hubei (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 0 days.

(21) Appl. No.: 15/326,229

(22) PCT Filed: Dec. 27, 2016

(86) PCT No.: PCT/CN2016/112240
§ 371 (c)(1),
(2) Date: Jan. 13, 2017

(87) PCT Pub. No.: WO2018/045676
PCT Pub. Date: Mar. 15, 2018

(65) Prior Publication Data

US 2018/0336811 A1 Nov. 22, 2018

(30) Foreign Application Priority Data

Sep. 6, 2016 (CN) ..... 2016 1 0804644

(51) Int. Cl.
*G09G 3/20* (2006.01)
*G09G 3/36* (2006.01)

(52) U.S. Cl.
CPC ..... *G09G 3/2007* (2013.01); *G09G 3/20* (2013.01); *G09G 3/2003* (2013.01); *G09G 3/36* (2013.01);

(Continued)

(58) Field of Classification Search
CPC ..... G09G 3/2007; G09G 2320/0242; G09G 2320/0626; G09G 2320/0666; G09G 2320/0673; G09G 2360/16
See application file for complete search history.

(56) References Cited

U.S. PATENT DOCUMENTS 6,593,934 B1 * 7/2003 Liaw ..... G09G 3/2092 345/590
2004/0155837 A1 * 8/2004 Yu ..... G09G 3/2003 345/63

(Continued)

FOREIGN PATENT DOCUMENTS

CN 101079954 11/2007
CN 101119497 2/2008

(Continued)

OTHER PUBLICATIONS

International Search Report and Written Opinion for International Application No. PCT/CN2016/112240, dated Jun. 1, 2017.

(Continued)

*Primary Examiner* — Antonio A Caschera
(74) *Attorney, Agent, or Firm* — Andrew C. Cheng

(57) ABSTRACT

A method for regulating brightness and chromaticity of a display panel includes: obtaining original gray-scale data; regulating gray-scales of green, so that brightness values of pixels match a standard gamma curve; matching color coordinates of red and blue using the gray-scales of green; determining a weight coefficient according to a gradation of the gray-scales of green; and calculating and recording color coordinates of target gray-scales of red and blue using the determined weight coefficient.

8 Claims, 5 Drawing Sheets

(52) U.S. Cl.
CPC ..... *G09G 2320/0242* (2013.01); *G09G 2320/0626* (2013.01); *G09G 2320/0666* (2013.01); *G09G 2320/0673* (2013.01); *G09G 2360/16* (2013.01)

(56) References Cited

U.S. PATENT DOCUMENTS

2014/0292837 A1* 10/2014 Jia ..... G09G 3/3413 345/690
2014/0333655 A1* 11/2014 Tu ..... G09G 5/02 345/591

FOREIGN PATENT DOCUMENTS

| | | |
|---|---|---|
| CN | 101860765 | 10/2010 |
| CN | 103928012 | 7/2014 |
| JP | 2000184382 | 6/2000 |
| JP | 2007158628 | 6/2007 |
| TW | 594822 | 6/2004 |

OTHER PUBLICATIONS

Chinese Office Action and Search Report for Chinese Patent Application No. 201610804644.5, dated Aug. 22, 2017.

* cited by examiner

METHOD AND SYSTEM FOR REGULATING BRIGHTNESS AND CHROMATICITY OF DISPLAY PANEL

CROSS-REFERENCE TO RELATED APPLICATIONS

This application claims the priority of Chinese patent application CN201610804644.5, entitled "Method and system for regulating brightness and chromaticity of display panel" and filed on Sep. 6, 2016, the entirety of which is incorporated herein by reference.

FIELD OF THE INVENTION

The present disclosure relates to the technical field of display, and in particular, to a method for regulating brightness and chromaticity of a display panel.

BACKGROUND OF THE INVENTION

With the development of display technology, liquid crystal display screens have become the most commonly used display devices. With superior features such as high space utilization, low power consumption, non-radiation, low electromagnetic interference and so on, the liquid crystal display screens are therefore widely used in TVs, mobile phones, tablet PCs and other information communication devices.

Original optical characteristics of liquid crystal display panels have certain drawbacks. For example, color points of gray-scales from 0 to 255 are inconsistent, and there is a color-shift phenomenon. For another example, a brightness change of gray-scales from 0 to 255 fails to meet characteristics of human eye observation. Therefore, the optical regulation of display panels is essential. According to a general optical regulation method, the display panel needs to be regulated repeatedly, and whether good display effects are achieved is determined by human eyes.

FIG. 1 shows ideal performances of color points. Only the color point of 0 gray-scale has a shift, while the rest gray-scales are concentrated in one point. FIG. 2 shows ideal gamma performance. It can be seen from FIG. 2 that brightness gradation of most gray-scales is in gamma 2.2.

A method for regulating brightness and chromaticity in the prior art is described below. First, a gamma junction is regulated, and then original data of gray-scales from 0 to 255 are measured. Next, original data are interpolated into finer data. After a target brightness is determined, a best value is searched according to fixed color coordinates. When the brightness reaches a standard, the color points always have a deviation. However, there must be a gradual change process of color coordinates in low gray-scales. When the same method is used, the searched color points have the deviation, and the low gray-scales needs to be regulated manually.

In the actual regulation, it is difficult to meet the brightness and chromaticity of low gray-scales at the same time. FIG. 3 shows performances of the color points using the regulating method in the prior art. It can be seen that, the low gray-scales have the deviation. FIG. 4 shows gamma performances using the regulating method in the prior art. It can be seen that, the gamma deviation is quite obvious. Hence, there is a technical problem of large deviation in the method for regulating brightness and chromaticity in the prior art.

SUMMARY OF THE INVENTION

The purpose of the present disclosure is to provide a method for regulating brightness and chromaticity of a display panel, so as to solve a technical problem of large deviation in the method for regulating brightness and chromaticity in the prior art.

The present disclosure provides a method for regulating brightness and chromaticity of a display panel, which comprises steps of:

obtaining original gray-scale data;

regulating gray-scales of green, so that brightness values of pixels match a standard gamma curve;

matching color coordinates of red and blue using the gray-scales of green;

determining a weight coefficient according to a gradation of the gray-scales of green; and calculating and recording color coordinates of target gray-scales of red and blue using the determined weight coefficient.

Preferably, the step of obtaining original data specifically is obtaining the original gray-scale data of 11-bits through a linear interpolation.

Preferably, the step of matching color coordinates of red and blue using the gray-scales of green specifically comprises the sub steps of:

calculating color coordinates of a temporary gray-scale;

obtaining an approximation line of color temperature according to color coordinates of 0 gray-scale and color coordinates of a target gray-scale;

calculating a first distance between the color coordinates of the temporary gray-scale and the color coordinates of the target gray-scale; and calculating a second distance between the color coordinates of the temporary gray-scale and the approximation line of color temperature.

Further, the step of determining a weight coefficient according to a gradation of the gray-scales of green specifically comprises sub steps of:

determining a first weight as 0.9, and a second weight as 0.1 when the gray-scales of green are low gray-scales;

determining a first weight as 0.5, and a second weight as 0.5 when the gray-scales of green are medium-low gray-scales; and determining a first weight as 1, and a second weight as 0 when the gray-scales of green are medium-high gray-scales.

Further, the step of calculating and recording color coordinates of target gray-scales of red and blue using determined weight coefficient specifically comprises sub steps of:

calculating a first product of the first weight and the first distance;

calculating a second product of the second weight and the second distance; and determining a distance between color coordinates of a target gray-scale of red or blue and the color coordinates of 0 gray-scale as a sum of the first product and the second product.

The present disclosure further provides a system for regulating brightness and chromaticity of a display panel, which comprises an optical measurement apparatus, a computer and a communication module, wherein the optical measurement apparatus is used to obtain original gray-scale data from a display device;

wherein the computer is connected to the display device through the communication module;

wherein the computer is used to regulate gray-scales of green, so that brightness values of pixels match a standard gamma curve; to match color coordinates of red and blue using the gray-scales of green; to determine a weight coefficient according to a gradation of the gray-scales of green;

and to calculate and record color coordinates of target gray-scales of red and blue using determined weight coefficient.

Preferably, the optical measurement apparatus is specifically used to obtain the original gray-scale data of 11-bits through a linear interpolation.

Preferably, the step of matching the color coordinates of red and blue using the gray-scales of green specially comprises the following sub steps of:

calculating color coordinates of a temporary gray-scale;

obtaining an approximation line of color temperature according to color coordinates of 0 gray-scale and color coordinates of a target gray-scale;

calculating a first distance between the color coordinates of the temporary gray-scale and the color coordinates of the target gray-scale; and calculating a second distance between the color coordinate of the temporary gray-scale and the approximation line of color temperature is calculated.

Further, the step of determining a weight coefficient according to a gradation of the gray-scales of green specifically comprises sub steps of:

determining a first weight as 0.9, and a second weight as 0.1 when the gray-scales of green are low gray-scales;

determining a first weight as 0.5, and the second weight as 0.5 when the gray-scales of green are medium-low gray-scales; and determining a first weight as 1, and the second weight as 0 When the gray-scales of green are medium-high gray-scales.

Further, the step of calculating and recording color coordinates of target gray-scales of red and blue using determined weight coefficient specifically comprises sub steps of:

calculating a first product of the first weight and the first distance;

calculating a second product of the second weight and the second distance; and determining a distance between color coordinates of a target gray-scale of red or blue and the color coordinates of 0 gray-scale as a sum of the first product and the second product.

The following beneficial effects can be brought about by the present disclosure. In the method for regulating brightness and chromaticity of the display panel provided by the present disclosure, the original gray-scale data are first obtained, and then the gray-scales of green are regulated, so that the brightness values of the pixels match the standard gamma curve. Next, the color coordinates of red and blue are matched using the gray-scales of green, and the weight coefficient is determined according to the gradation of the gray-scales of green. The color coordinates of the target gray-scales of red and blue are calculated and recorded using the determined weight coefficient. According to the regulating method provided by the embodiment of the present disclosure, automatic regulation of brightness and chromaticity can be realized, and actual color characteristics of low gray-scales can be maintained. The colors can change in such a way that a best visual effect can be obtained, and the technical problem of large deviation in the method for regulating brightness and chromaticity in the prior art can be solved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

In order to describe the technical solutions in the embodiments of the present disclosure more clearly, the accompanying drawings required in the description of the embodiments will be briefly described as follows.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Embodiment 1

Figure 1:
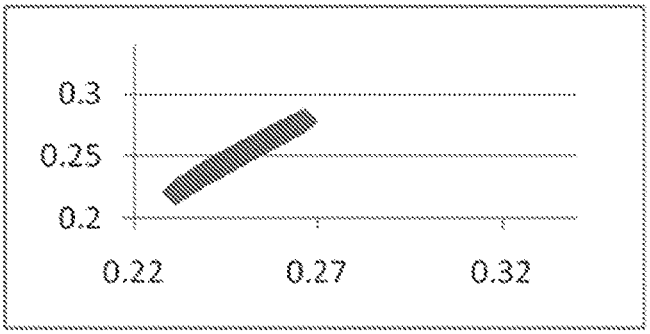
FIG. 1 schematically shows ideal performances of color points.
Figure 2:
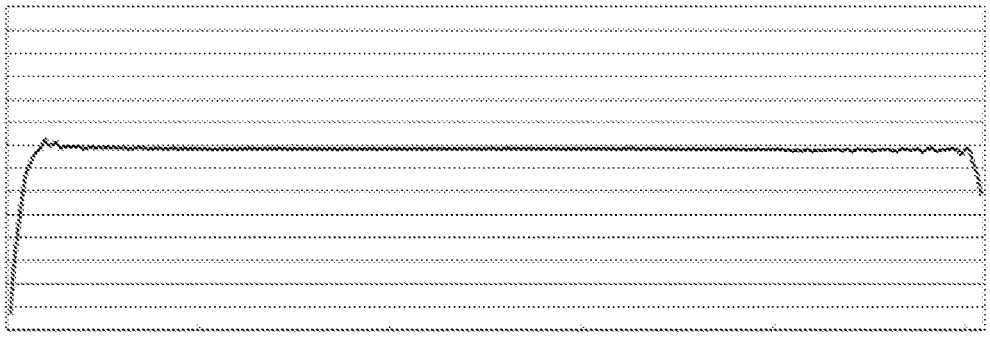
FIG. 2 schematically shows ideal gamma performance.
Figure 3:
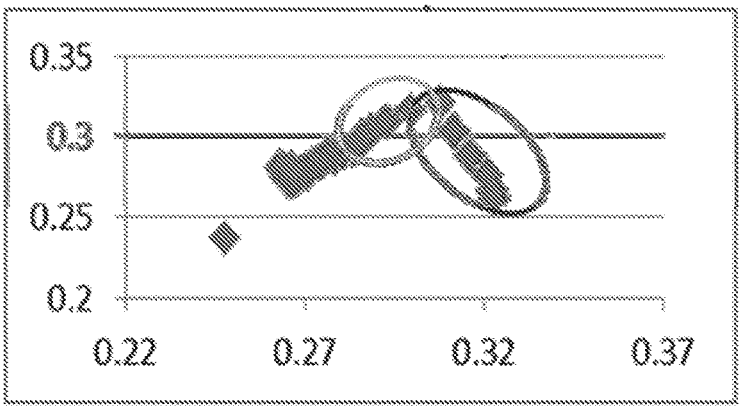
Fig. 3 (Prior Art)
FIG. 3 schematically shows performances of color points according to a regulating method in the prior art.
Figure 4:
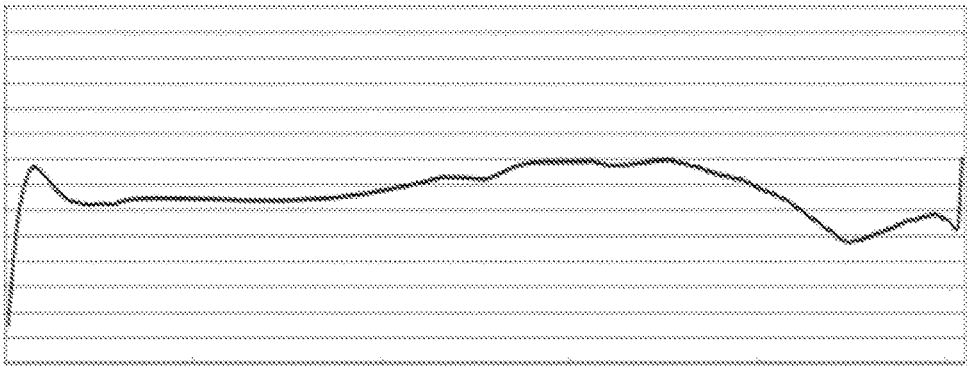
Fig. 4 (Prior Art)
FIG. 4 schematically shows gamma performance according to the regulating method in the prior art.
Figure 5:
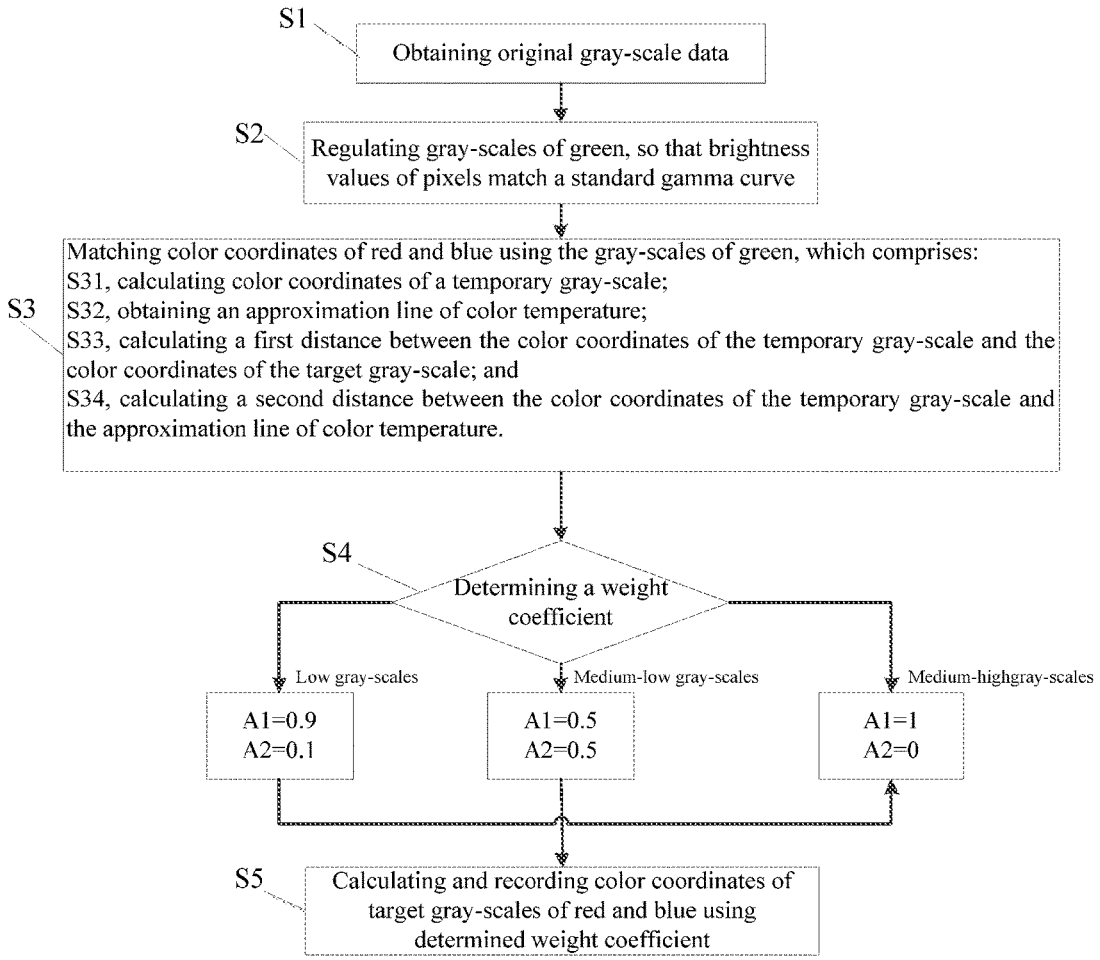
FIG. 5 is a flowchart of a method for regulating brightness and chromaticity of a display panel provided by an embodiment of the present disclosure.

As shown in FIG. 5, the embodiment of the present disclosure provides a method for regulating brightness and chromaticity of a display panel, which comprises following steps.

S1: original gray-scale data are obtained.

Specifically, after original gray-scale data of 8 bits of a display device are obtained, original gray-scale data of 11 bits can be obtained through a linear interpolation, so as to obtain finer original data.

S2: gray-scales of green are regulated, so that brightness values of pixels match a standard gamma curve.

Specifically, only 0 to 255 gray-scales of green sub-pixels are regulated, so that brightness values of pixels match the standard gamma curve.

S3: color coordinates of red and blue are matched using the gray-scales of green. S3 specifically comprises following sub steps.

Figure 6:
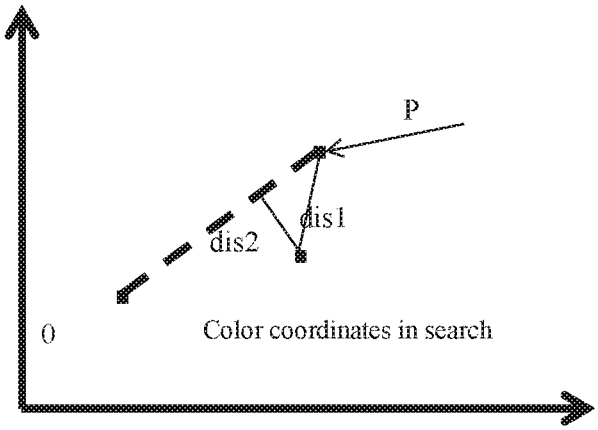
FIG. 6 schematically shows a coordinate system of gray-scales in an embodiment of the present disclosure.

S31: color coordinates ($x_{temp}$, $y_{temp}$) of a temporary gray-scale are calculated. As shown in FIG. 6, point temp represents the color coordinates of the temporary gray-scale.

S32: an approximation line of color temperature is obtained according to color coordinates of 0 gray-scale and color coordinates of a target gray-scale. As shown in FIG. 6, point 0 represents the color coordinates of 0 gray-scale, and point P represents the color coordinates of the target gray-scale.

S33: a first distance (dis1) between the color coordinates of the temporary gray-scale and the color coordinates of the target gray-scale is calculated.

The first distance (dis1) between the color coordinates of the gray-scale and the color coordinates of the target gray-scale can be calculated using a calculation formula for a distance between two points.

S34: a second distance (dis2) between the color coordinates of the temporary gray-scale and the approximation line of color temperature is calculated.

The second distance (dis2) between the color coordinates of the temporary gray-scale and the approximation line of color temperature can be calculated using a calculation formula for a distance between a point and a straight line.

S4: a weight coefficient is determined according to a gradation of the gray-scales of green.

A first weight A1 is 0.9, and a second weight A2 is 0.1 when the gray-scales of green are low gray-scales, for example, the gray-scales of green are lower than 63.

A first weight A1 is 0.5, and a second weight A2 is 0.5 when the gray-scales of green are medium-low gray-scales, for example, the gray-scales of green are in a range from 64 to 127.

A first weight A1 is 1, and a second weight A2 is 0 when the gray-scales of green are medium-high gray-scales, for example, the gray-scales of green are higher than 128.

S5: color coordinates of target gray-scales of red and blue are calculated and recorded using determined weight coefficient.

Specifically, a first product of the first weight and the first distance is calculated, i.e., A1×dis1; and then, a second product of the second weight and the second distance is calculated, i.e., A2×dis2. A distance between color coordinates of a target gray-scale of red or blue and the color coordinates of 0 gray-scale is a sum of the first product and the second product, i.e., dis=A1×dis1+A2×dis2. Besides, the color coordinates of the target gray-scale are on the approximation line of color temperature, and thus the color coordinates of the target gray-scale can be calculated.

Figure 7:
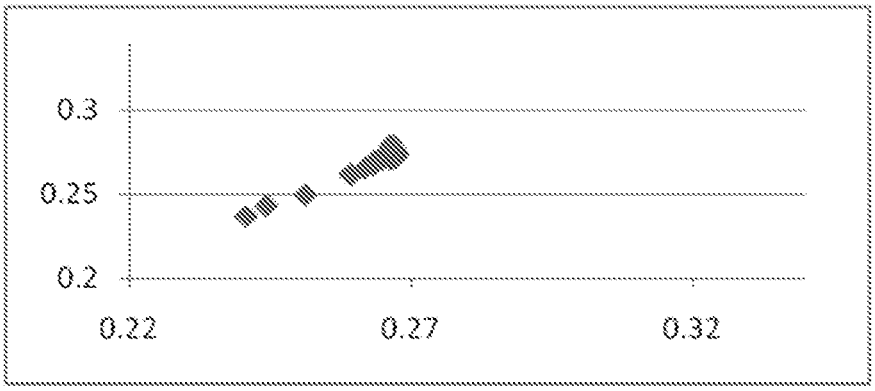
FIG. 7 schematically shows performances of color points in an embodiment of the present disclosure.

FIG. 7 is a final regulation result in the embodiment of the present disclosure. The change of color points of low gray-scales is not very uniform in actual performance, but the vision of human eye can be satisfied.

According to the regulating method provided by the embodiment of the present disclosure, automatic regulation of brightness and chromaticity can be realized, and actual color characteristics of low gray-scales can be maintained. The colors can change in such a way that a best visual effect can be obtained, and the technical problem of large deviation in the method for regulating brightness and chromaticity in the prior art can be solved.

Embodiment 2

Figure 8:
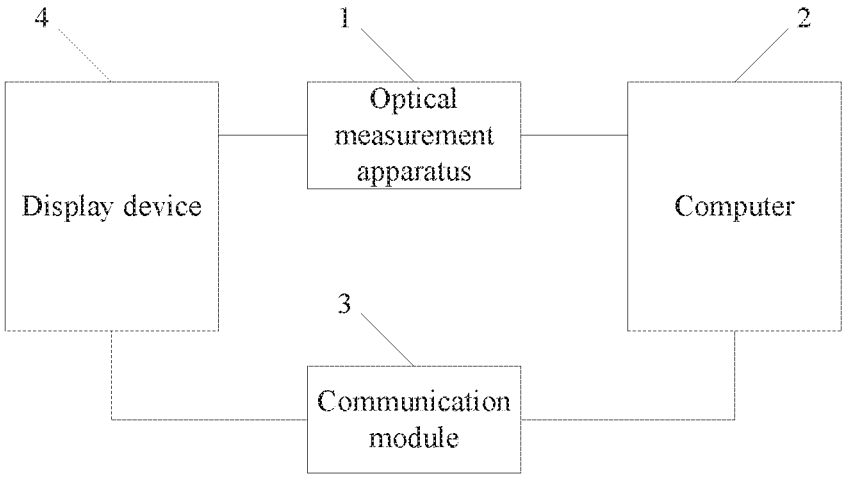
FIG. 8 schematically shows a system for regulating brightness and chromaticity, of a display panel provided by an embodiment of the present disclosure.

As shown in FIG. 8, the embodiment of the present disclosure provides a system for regulating brightness and chromaticity of a display panel. The system comprises an optical measurement apparatus 1, a computer 2, and a communication module 3.

The optical measurement apparatus 1 is used to obtain original gray-scale data from a display device 4. After original gray-scale data of 8 bits of the display device 4 are obtained, original gray-scale data of 11 bits can be obtained through a linear interpolation, so as to obtain finer original data.

The computer 2 is connected to the display device 4 through the communication module 3. The computer 2 is used to regulate gray-scales of green, so that brightness values of pixels match a standard gamma curve. The computer 2 only regulates 0 to 255 gray-scales of green sub-pixels, so that the brightness values of the pixels match the standard gamma curve.

The computer 2 further matches color coordinates of red and blue using the gray-scales of green. The computer 2 first calculates color coordinates of a temporary gray-scale ($x_{temp}$, $y_{temp}$). As shown in FIG. 6, point temp represents the color coordinates of the temporary gray-scale. Then an approximation line of color temperature is obtained according to color coordinates of 0 gray-scale and color coordinates of a target gray-scale. As shown in FIG. 6, point 0 represents the color coordinates of 0 gray-scale, and point P represents the color coordinates of the target gray-scale. At last, a first distance (dis1) between the color coordinates of the temporary gray-scale and the color coordinates of the target gray-scale is calculated using a calculation formula for a distance between two points, and a second distance (dis2) between the color coordinates of the temporary gray-scale and the approximation line of color temperature is calculated using a calculation formula for a distance between a point and a straight line.

The computer 2 further determines a weight coefficient according to a gradation of the gray-scales of green. When the gray-scales of green are low gray-scales, for example, the gray-scales of green are lower than 63, a first weight A1 is 0.9, and a second weight A2 is 0.1. When the gray-scales of green are medium-low gray-scales, for example, the gray-scales of green are in a range from 64 to 127, a first weight A1 is 0.5, and a second weight A2 is 0.5. When the gray-scales of green are medium-high gray-scales, for example, the gray-scales of green are higher than 128, a first weight A1 is 1, and a second weight A2 is 0.

The computer 2 further calculates and records color coordinates of target gray-scales of red and blue using determined weight coefficient. Specifically, a first product of the first weight and the first distance is calculated, i.e., A1×dis1; and then, a second product of the second weight and the second distance is calculated, i.e., A2×dis2. A distance between color coordinates of a target gray-scale of red or blue and the color coordinates of 0 gray-scale is a sum of the first product and the second product, i.e., dis=A1×dis1+A2×dis2. Besides, the color coordinates of the target gray-scale are on the approximation line of color temperature, and thus the color coordinates of the target gray-scale can be calculated.

FIG. 7 is a final regulation result in the embodiment of the present disclosure. The change of color points of low gray-scales is not very uniform in actual performance, but the vision of human eye can be satisfied.

According to the regulating system provided by the embodiment of the present disclosure, automatic regulation of brightness and chromaticity can be realized, and actual color characteristics of low gray-scales can be maintained. The colors can change in such a way that a best visual effect can be obtained, and the technical problem of large deviation in the method for regulating brightness and chromaticity in the prior art can be solved.

The technical feature of the system for regulating brightness and chromaticity of the display panel provided by the present embodiment is the same as that of the method for regulating brightness and chromaticity of the display panel provided by the aforesaid embodiment. As a result, they can solve the same technical problem and bring about the same technical effect.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A method for regulating brightness and chromaticity of a display panel, comprising steps of:

obtaining original gray-scale data;

regulating gray-scales of green, so that brightness values of pixels match a standard gamma curve;

matching color coordinates of red and blue using the gray-scales of green;

determining a weight coefficient according to a gradation of the gray-scales of green; and calculating and recording color coordinates of target gray-scales of red and blue using determined weight coefficient, so as to determine chromaticity values of the pixels, wherein the step of matching color coordinates of red and blue using the gray-scales of green specifically comprises sub steps of:

calculating color coordinates of a temporary gray-scale;

obtaining an approximation line of color temperature according to color coordinates of 0 gray-scale and color coordinates of a target gray-scale;

calculating a first distance between the color coordinates of the temporary gray-scale and the color coordinates of the target gray-scale; and calculating a second distance between the color coordinates of the temporary gray-scale and the approximation line of color temperature.

2. The method according to claim 1, wherein the step of obtaining original gray-scale data specifically is obtaining the original gray-scale data of 11-bits through a linear interpolation.

3. The method according to claim 1, wherein the step of determining a weight coefficient according to a gradation of the gray-scales of green specifically comprises sub steps of:

determining a first weight as 0.9 and a second weight as 0.1 when the gray-scales of green are low gray-scales;

determining a first weight as 0.5 and a second weight as 0.5 when the gray-scales of green are medium-low gray-scales; and determining a first weight as 1 and a second weight as 0 when the gray-scales of green are medium-high gray-scales.

4. The method according to claim 3, wherein the step of calculating and recording color coordinates of target gray-scales of red and blue using determined weight coefficient specifically comprises sub steps of:

calculating a first product of the first weight and the first distance;

calculating a second product of the second weight and the second distance; and determining a distance between color coordinates of a target gray-scale of red or blue and the color coordinates of 0 gray-scale as a sum of the first product and the second product.

5. A system for regulating brightness and chromaticity of a display panel, comprising an optical measurement apparatus, a computer, and a communication module, wherein the optical measurement apparatus is used to obtain original gray-scale data from a display device;

wherein the computer is connected to the display device through the communication module; and wherein the computer is used to regulate gray-scales of green, so that brightness values of pixels match a standard gamma curve; to match color coordinates of red and blue using the gray-scales of green; to determine a weight coefficient according to a gradation of the gray-scales of green; and to calculate and record color coordinates of target gray-scales of red and blue using determined weight coefficient, so as to determine chromaticity values of the pixels, wherein the step of matching the color coordinates of red and blue using the gray-scales of green specifically comprises sub steps of:

calculating color coordinates of a temporary gray-scale;

obtaining an approximation line of color temperature according to color coordinates of 0 gray-scale and color coordinates of a target gray-scale;

calculating a first distance between the color coordinates of the temporary gray-scale and the color coordinates of the target gray-scale; and calculating a second distance between the color coordinates of the temporary gray-scale and the approximation line of color temperature.

6. The system according to claim 5, wherein the optical measurement apparatus is specifically used to obtain the original gray-scale data of 11-bits through a linear interpolation.

7. The system according to claim 5, wherein the step of determining a weight coefficient according to a gradation of the gray-scales of green specifically comprises sub steps of:

determining a first weight as 0.9 and a second weight as 0.1 when the gray-scales of green are low gray-scales;

determining a first weight as 0.5 and a second weight as 0.5 when the gray-scales of green are medium-low gray-scales; and determining a first weight as 1 and a second weight as 0 when the gray-scales of green are medium-high gray-scales.

8. The system according to claim 7, wherein the step of calculating and recording color coordinates of target gray-scales of red and blue using determined weight coefficient specifically comprises sub steps of:

calculating a first product of the first weight and the first distance;

calculating a second product of the second weight and the second distance; and determining a distance between color coordinates of a target gray-scale of red or blue and the color coordinates of 0 gray-scale as a sum of the first product and the second product.

* * * * *